US007559628B2

(12) United States Patent
Sakurai

(10) Patent No.: US 7,559,628 B2
(45) Date of Patent: Jul. 14, 2009

(54) HEAD SUBSTRATE, RECORDING HEAD, HEAD CARTRIDGE AND RECORDING APPARATUS THEREWITH

(75) Inventor: Masataka Sakurai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 414 days.

(21) Appl. No.: 11/291,957

(22) Filed: Dec. 2, 2005

(65) Prior Publication Data

US 2006/0125872 A1 Jun. 15, 2006

(30) Foreign Application Priority Data

Dec. 9, 2004 (JP) ..... 2004-357183

(51) Int. Cl.
*B41J 2/05* (2006.01)

(52) U.S. Cl. ..... 347/57

(58) Field of Classification Search ..... 347/5, 347/9–12

See application file for complete search history.

(56) References Cited

U.S. PATENT DOCUMENTS 6,290,334 B1 9/2001 Ishinaga et al.
6,302,504 B1 * 10/2001 Imanaka et al. ..... 347/9
6,474,770 B1 * 11/2002 Endo ..... 347/19
2002/0036782 A1 * 3/2002 Furukawa ..... 358/1.4
2005/0237353 A1 * 10/2005 Oomura et al. ..... 347/9
2006/0139412 A1 6/2006 Sakurai et al.

* cited by examiner

*Primary Examiner*—Stephen D Meier
*Assistant Examiner*—Alexander C Witkowski
(74) *Attorney, Agent, or Firm*—Fitzpatrick, Cella, Harper & Scinto

(57) ABSTRACT

An ink-jet recording head substrate which is mounted with electrothermal transducers producing thermal energy used for discharging ink and which drives the electrothermal transducers, comprising: a production circuit operating on a first voltage and producing a selection signal indicating driving or non-driving of the electrothermal transducer; a conversion circuit for converting the produced selection signal into a selection signal of a second voltage higher than the first voltage; and a driving circuit operating on the second voltage and driving the electrothermal transducer in accordance with the selection signal of the second voltage. The ink-jet recording head substrate includes a circuit which operates on the second voltage and which outputs the detection signal if the first voltage is less than a predetermined level, and sets a selection signal supplied to a circuit which operates on the second voltage and which performs the above driving if the detection signal is outputted, in a state indicating non-driving.

13 Claims, 12 Drawing Sheets

HEAD SUBSTRATE, RECORDING HEAD, HEAD CARTRIDGE AND RECORDING APPARATUS THEREWITH

FIELD OF THE INVENTION

The present invention relates to an ink-jet recording head substrate, an ink-jet recording head and a recording apparatus therewith, in particular, an ink-jet recording head formed with an electrothermal transducer for producing thermal energy necessary to discharge ink and a driving circuit for driving the electrothermal transducer on the identical substrate and a recording apparatus therewith.

BACKGROUND OF THE INVENTION

Generally, an electrothermal transducer (heater) of a recording head mounted on a recording apparatus acting on an ink-jet system and a driving circuit thereof, as disclosed in U.S. Pat. No. 6,290,334, for example, is formed on the identical substrate using a semiconductor process technique. In addition to the driving circuit, there has been proposed a configuration of the recording head having: a digital circuit or the like which detects a state of a semiconductor substrate such as a temperature of a substrate is formed on the identical substrate; ink supply ports around the center of the substrate; and heaters facing each other at such positions as to sandwich each of the ink supply ports.

FIG. 1 is a view illustrating a frame format of circuit blocks and ink supply ports of this kind of ink-jet recording head substrate (head substrate). FIG. 1 illustrates six ink supply ports 111 on the semiconductor substrate of the head substrate 110. FIG. 1 illustrates only the circuit block provided for the ink supply port 111 on the left for convenience and illustration of the circuit blocks provided for the other five ink supply ports 111 is omitted. As illustrated in FIG. 1, the heaters 112 are disposed in an array manner at such positions as to face each other, sandwiching each of the ink supply port 111 therebetween. The circuit blocks (driving circuits 113) for selectively driving the heaters 112 are disposed so as to be provided for the heaters 112. Pads 114 for supplying power and signals to the heaters 112 and driving circuits 113 are arranged at one end of the semiconductor substrate 110.

FIG. 2 is a view illustrating a frame format of a circuit configuration and signal flows of the driving circuits 113 in FIG. 1. Signals including image data and the like applied to the pads 114 are inputted into a block selection circuit 203 (constituted of a shift register, mainly) and a time-division selection circuit 202 (constituted of decoders, mainly) which constitutes an internal circuit through an input circuit 201. An example illustrated in FIG. 2 shows that the inputted image data is converted into a time-division selection signal by the time-division selection circuit 202. The time-division selection signal is transmitted to each of heater driving blocks 1 to 8 (204). The block selection circuit 203 produces a block selection signal for selecting the heater driving blocks 1 to 8 based on an image data signal synchronous with a synchronizing signal (clock) used to input an image data. The heater driving block selected by the block selection signal drives the heater in accordance with the time-division selection signal. That is, a heater driven by AND of the block selection signal and the time-division selection signal is decided.

FIG. 3 illustrates a detail configuration of a heater driving block 204. The heater driving block 204 includes heater driving MOS transistors 306, level conversion circuits 304 and heater selection circuits 305 disposed so as to be provided for the heater 112 arranged in an array manner. The heater driving MOS transistors 306 function as a switch for turning on and off the energization of the heater 112. A block selection signal 302 from the block selection circuit 203 and a time-division selection signal 303 from the time-division selection circuit are inputted into an AND gate of the heater selection circuit 305. Accordingly, if both of the two signals 302, 303 are active, an output of the AND gate becomes active. An output signal of the AND gate is level-converted by a level conversion circuit 304 into such a power voltage (second power voltage) that a voltage amplitude of the signal is higher than a driving voltage (first power voltage) from an input circuit to the heater selection circuit 305. The level-converted signal is applied to a gate of the heater driving MOS transistor 306. The heater 112 connected to the heater driving MOS transistor 306 to which the signal is applied to the gate is energized current and driven. The reason the level conversion circuit 304 makes a level conversion into the second power voltage in the heater driving block 204 is that the voltage applied to the gate of the heater driving MOS transistor 306 is increased to decrease on-resistance thereof, thus passing electric current through the heater with high efficiency.

FIG. 4 illustrates an internal circuit of a general level conversion circuit 304 and a peripheral circuit thereof. The level conversion circuit 304 is divided into a circuit section 304*a* operating on the first power voltage and a circuit section 304*b* operating on the second power voltage. A heater selection signal 401 as an output from the heater selection circuit 305 is inputted into an inverter 412*a* (constituted of a PMOS transistor 410 and a NMOS transistor 411) operating on the first power voltage. The inverter 412*a* produces an inversed logic signal of the heater selection signal 401 and applies the signal to gates of a NMOS transistor 414 and a PMOS transistor 413 operating on the second power voltage. An inversion signal of the inverter 412*a* is inputted into an inverter 412*b* for the second inversion. An output signal of the inverter 412*b* is applied to gates of a NMOS transistor 416 and a PMOS transistor 415 operating on the second power voltage. The circuit section 304*b* produces a signal having an amplitude value of the second power voltage for switching the heater driving MOS transistor 306 in accordance with these input signals and inputs the signal into the gate of the heater driving MOS transistor 306.

As described above, the circuit of the ink-jet recording head substrate includes the circuit block operating on the first power voltage having the voltage amplitude of an input signal and the circuit block operating on the higher second power voltage to be applied to the gate of the MOS transistor for controlling a current flowing the heater (hereinafter referred to as heater current). That is, the ink-jet recording head substrate has a configuration so as to be controlled and driven by two types of power voltages, namely a first and a second power voltages, and so as to convert the signal amplitude of the first power voltage into the signal amplitude of the second power voltage by the level conversion circuit.

The first and the second power voltages are power voltages supplied to the respective recording head substrates from a printer body. In starting power supply, the order of application of the second power voltage and the heater power voltage after application of the first power voltage is required to be observed. This is because application of the second power voltage and heater voltage under no application of the first power voltage may cause an output of the level conversion circuit 304 to be unstable and the heater driving MOS transistor 306 to be ON, thus continuing to energize heater current. To achieve such a power input order, measures are required to be taken in the printer body, which causes a cost increase.

SUMMARY OF THE INVENTION

In view of the aforementioned problem, it is an object of the present invention to eliminate restrictions on the power input order and to achieve stable operation even if power supply is inputted in any order in an ink-jet recording head substrate supplied with a plurality of voltages.

An ink-jet recording head substrate according to the present invention has the following configuration, that is, an ink-jet recording head substrate which is mounted with electrothermal transducers producing thermal energy used for discharging ink and which drives the electrothermal transducers, comprises: a production unit configured to operate on a first voltage and produce a selection signal indicating driving or non-driving of the electrothermal transducer; a conversion unit configured to convert the selection signal produced by the production means into a selection signal of a second voltage higher than the first voltage; a driving unit configured to operate on the second voltage and drive the electrothermal transducer in accordance with the selection signal of the second voltage; a detection unit configured to operate on the second voltage and output a detection signal if the first voltage is less than a predetermined level; and a control unit configured to operate on the second voltage and keep the selection signal supplied to the driving unit under such a state as to indicate non-driving in a case where the detection signal is outputted.

The present invention provides an ink-jet recording head with the ink-jet recording head substrate and an ink-jet recording apparatus with the ink-jet recording head.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

"Record or recording" (sometimes called "print") used herein means to widely form images, patterns or the like on recording medium, or to process medium whether significant or insignificant in addition to a case where significant information such as characters and graphics are formed, and whether or not a human being is exposed so as to be visible and perceptible.

"Recording medium" widely refers to a substance which has acceptability for ink, such as cloth, plastic film, metallic plate, glass, ceramics, lumber, leather or the like, in addition to paper used for general recording apparatus.

Moreover "ink" (sometimes called "liquid") should be widely interpreted in the same way as a definition of "Record (print)" described above and refers to liquid subjected to formation of images, patterns or the like or processing of recording medium or ink treatment (for example, solidification or insolubility of coloring material in ink given to the recording medium) by being given onto the recording medium.

Furthermore, "nozzle" refers to, in the lamp, a discharge opening or a fluid passage communicating with the discharge opening and an element that produces energy used for ink discharge unless otherwise provided.

An expression of "on element substrate" used for description indicates not only the top of an element substrate, but also a surface of the element substrate or element substrate interior side near the surface. Also, "built-in" described herein indicates to integrally form and manufacture each of elements on a element substrate by means of a manufacturing process of a semiconductor circuit or the like, not to simply arrange each of separate elements on a substrate.

First Embodiment

Figure 9:
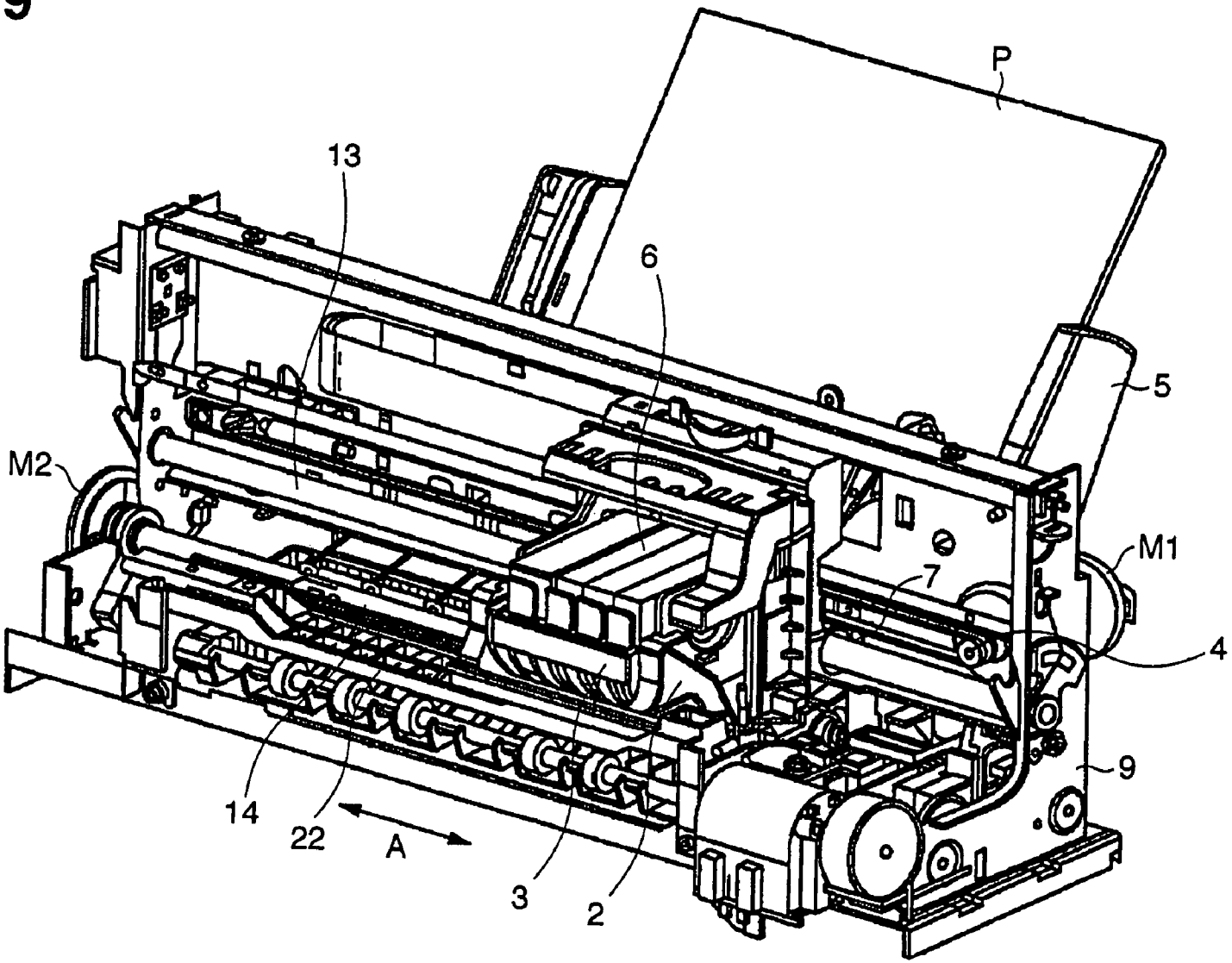
FIG. 9 is a sectional view of an ink-jet recording apparatus according to a typical embodiment of the present invention.

First, the present invention is described with an example of an applicable ink-jet recording apparatus. FIG. 9 is a sectional view illustrating a structural outline of an ink-jet recording apparatus 1 according to a typical embodiment of the present invention.

As illustrated in FIG. 9, the ink-jet recording apparatus, hereinafter referred to as a "recording apparatus", transmits a driving force generated by a carriage motor M1 to a carriage 2 installed with a recording head 3, which discharges ink for recording in accordance with an ink-jet system, with a transmission mechanism, reciprocates the carriage 2 in a direction of an arrow A, and, for example, feeds a recording medium P such as recording paper through a paper feeding mechanism 5, conveys the paper to a recording position, and discharges ink onto the recording medium P from the recording head 3 at the recording position, thus performing recording.

To properly maintain a state of the recording head 3, the carriage 2 is moved to a position of a recovery device 10 and discharge recovery of the recording head 3 is intermittently performed.

The carriage 2 of the recording apparatus 1 is installed with an ink cartridge 6 for storing ink to be supplied to the recording head 3, in addition to the recording head 3. The ink cartridge 6 is designed so as to be detachable to the cartridge 2.

The recording apparatus 1 illustrated in FIG. 9 permits color print, for the purpose of which the carriage 2 has four ink cartridges storing magenta (M), cyan (C), yellow (Y) and black (K) respectively. The four ink cartridges are independently detachable, respectively.

The carriage 2 and the recording head 3 are designed so that joint surfaces of both the members are brought into appropriate contact with each other for attainment and maintenance of prescribed electric connection. The recording head 3 selectively discharges ink from the plurality of discharge openings for recording, by applying energy in response to a recording signal. Especially, the recording head 3 according to this embodiment employs an ink-jet system discharging ink using thermal energy and discharges ink from a corresponding one of discharge openings by applying a pulse voltage to a corresponding electrothermal transducer according to the recording signal.

In FIG. 9, a reference numeral 14 denotes a conveyance roller driven by a conveyance motor M2 to convey the recording medium P.

The above example shows the recording head is configurated so as to be separatable from the ink cartridge for storing ink. As illustrated below, a head cartridge in which the recording heads and the ink cartridges are integrated may be installed on the carriage 2.

Figure 10:
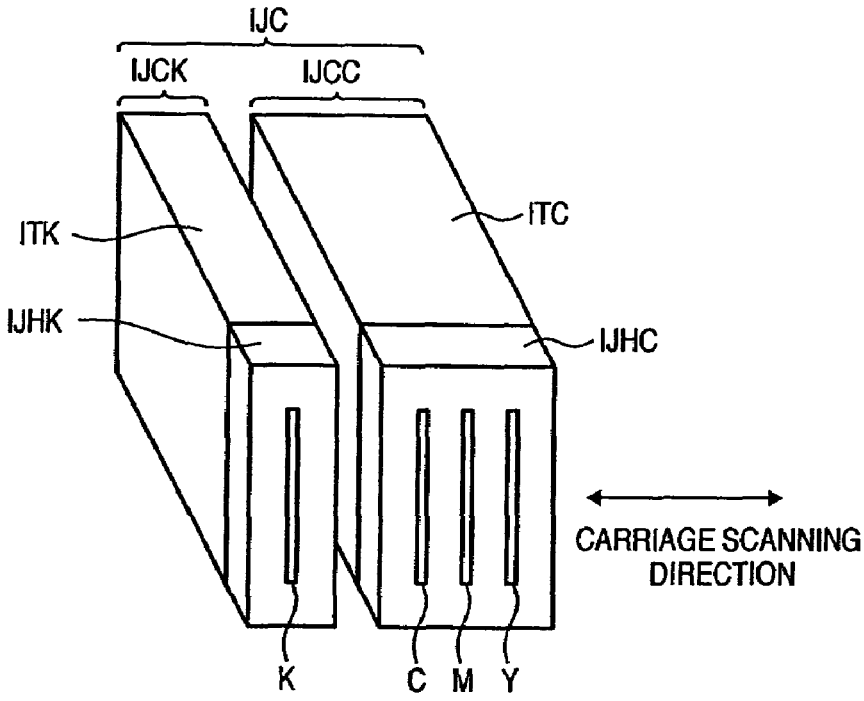
FIG. 10 is an external perspective view illustrating an example of a head cartridge configuration.

FIG. 10 is an external perspective view illustrating an example of a head cartridge configuration. FIG. 9 illustrates that the ink cartridge 6 is separate from the recording head 3, however, the ink-jet recording head substrate of the present invention is applicable to a head cartridge in which the ink cartridge and the recording head are integrated.

As illustrated in FIG. 10, the ink-jet cartridge IJC consists of a cartridge IJCK discharging black ink and a cartridge IJCC discharging three-color ink of cyan (C), magenta (M) and yellow (Y). The two cartridges are separable from each other, each of which is independently detachable to the carriage 2.

The cartridge IJCK consists of an ink tank ITK for storing black ink and a recording head IJHK discharging black ink for recording, which are of an integrated type. Likewise, the cartridge IJCC consists of an ink tank ITC for storing three-color ink of cyan (C), magenta (M) and yellow (Y) and a recording head IJHC discharging these color ink for recording, which are of an integrated type. This embodiment uses a cartridge of which ink tank is filled with ink.

As is evident from FIG. 10, a nozzle row for discharging black ink, a nozzle row for discharging cyan ink, a nozzle row for discharging magenta ink and a nozzle row for discharging yellow ink are arranged side by side in a traveling direction of the carriage. Arranging directions of the nozzles cross the traveling direction of the carriage.

Figure 11:
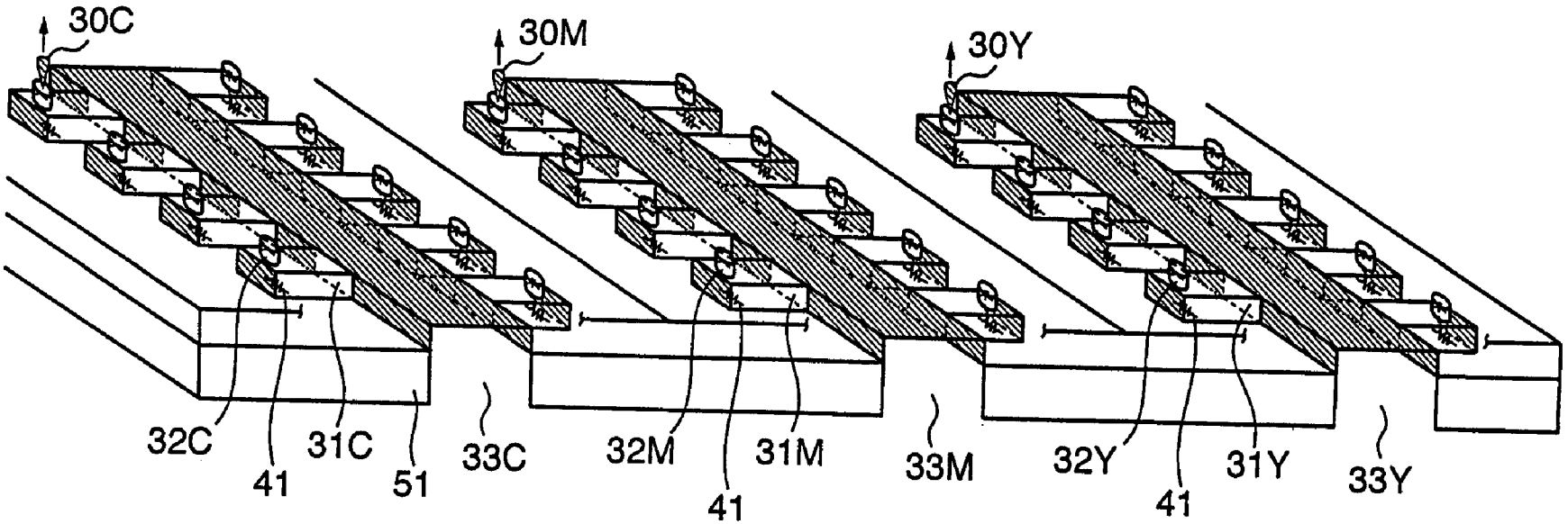
FIG. 11 is a perspective view illustrating a stereoscopic configuration of a recording head IJHC discharging three types of color ink.

Next, a head substrate used for the recording head 3 of the recording apparatus having the above configuration will be described below. FIG. 11 is a perspective view illustrating a stereoscopic configuration of a recording head IJHC discharging three-color ink.

FIG. 11 clearly illustrates flows of ink supplied from the ink tank ITC. The recording head IJHC is provided with an ink channel 33C for supplying cyan (C) ink, an ink channel 33M for supplying magenta (M) ink and an ink channel 33Y for supplying yellow (Y) ink. The ink tank ITC is formed with supply passages (not illustrated) for supplying each ink to the respective ink channels from the bottom side of the substrate.

C ink, M ink and Y ink are respectively guided to the electrothermal transducers (heaters) 41 provided on the substrate through the ink channels by ink flow passages 31C, 31M and 31Y. When the electrothermal transducers (heaters) 41 are energized through a circuit described later, heat is given to ink on the electrothermal transducers (heaters) 41. This heat boils ink, thus the resulting bubbles discharge ink droplets 30C, 30M and 30Y from discharging openings 32C, 32M and 32Y.

In FIG. 11, a reference numeral 51 is a head substrate formed with the electrothermal transducers described later, various circuits for driving the converting elements, memories, various pads as electric contacts with carriages HC and various signal lines.

MOS-FET for driving one of the electrothermal transducers (heaters) and the electrothermal transducers are collectively called a recording element, and a plurality of recording elements are generically called a recording element section.

FIG. 11 illustrates a stereoscopic configuration of the recording head IJHC discharging color ink. The recording head IJHK discharging black ink has the same configuration as the recording head IJHC. However, the configuration thereof is ⅓ as large as the configuration illustrated in FIG. 11. That is, the number of the ink channels is one and the scale of the head substrate is approx. ⅓.

Figure 12:
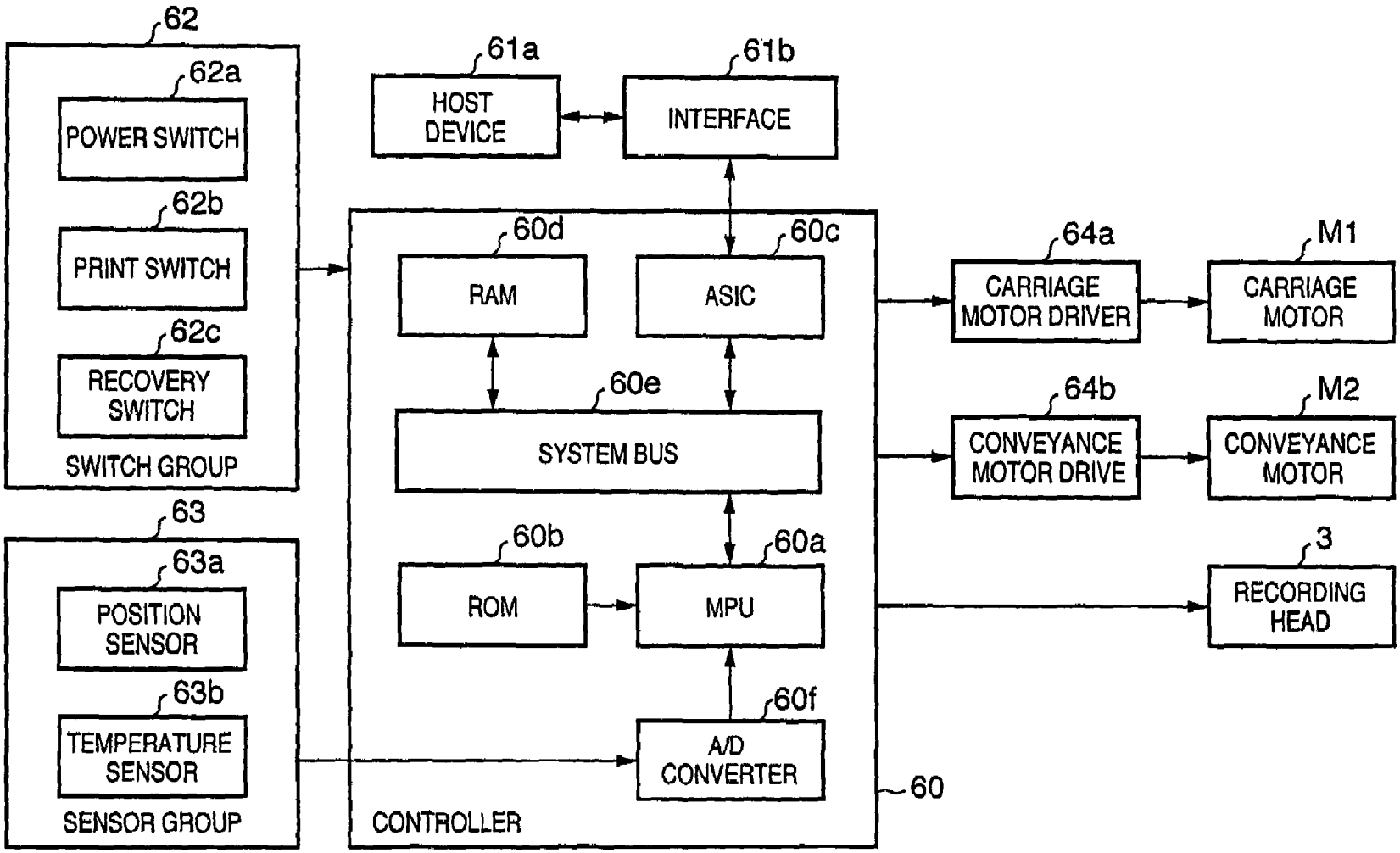
FIG. 12 is a schematic block diagram illustrating a control configuration of the recording apparatus illustrated in FIG. 9.

Next, a control configuration of the ink-jet recording apparatus will be described. FIG. 12 is a schematic block diagram illustrating a control configuration of the recording apparatus illustrated in FIG. 9.

As illustrated in FIG. 12, a controller 60 is provided with a MPU60*a*, a program corresponding to a control sequence described later, a prescribed table and a ROM60*b* storing other fixed data. In the controller 60, an integrated circuit for special use (ASIC) 60*c* produces control signals for controlling the carriage motor M1, the conveyance motor M2 and the recording head 3. RAM60*d* provides a deployment region for image data and a working region for program execution. A system bus 60*e* mutually connects MPU60*a*, ASIC60*c* and RAM60*d* for data transmission and reception. An A/D converter 60*f* inputs an analog signal from a sensor group described below for A/D conversion to transmit a digital signal to the MPU60*a*.

In FIG. 12, a reference character 61*a* denotes a computer (or a reader for reading images, a digital camera or the like) as a supply source of image data and is genetically called a host device. Between the host device 61*a* and the recording apparatus 1, an image data, a command, a status signal or the like is transmitted and received through an interface (I/F) 61*b*.

Moreover, a reference numeral 62 denotes a switch group constituted of switches for receiving command inputs by an operator. The switch group 62 includes, for example, a power switch 62*a*, a print switch 62*b* for commanding print start and a recovery switch 62*c* for indicating start of processing (recovery) for maintaining ink discharge performance of the recording head 3 in a good state. A reference numeral 63 is a sensor group for detecting an apparatus state, which is constituted of a position sensor 63*a* such as a photo coupler for detecting a home position h and a temperature sensor 63*b* provided at appropriate positions of the recording apparatus to detect an environmental temperature.

Furthermore, a reference character 64*a* denotes a carriage motor driver which drives the carriage motor M1 for reciprocation-scanning the carriage 2 in a direction of an arrow A and a reference character 64*b* is a conveyance motor driver which drives the conveyance motor M2 for conveying the recording medium P.

ASIC60*c* transmits driving data (DATA) of the recording element (heater) to the recording head while making direct access to a storage region of RAM60*d* at the time of recording scanning by the recording head 3.

Next, a detailed description will be made on the head substrate (element substrate) using for the recording head of the recording apparatus having above configuration. Above all, a configuration of a driving circuit created on the head substrate (on element substrate) will be described below. As described above, on the head substrate, there is provided a member (not illustrated) which forms the ink discharge openings 30C, 30M, 30Y and the flow passages 31C, 31M, 31Y communicating with the ink discharge openings so as to correspond to the respective recording elements. This member constitutes the recording head. The ink supplied onto the recording element is heated by driving the recording element, so that bubbles are generated by film boiling, thus discharging the ink from the discharge opening.

Figure 1:
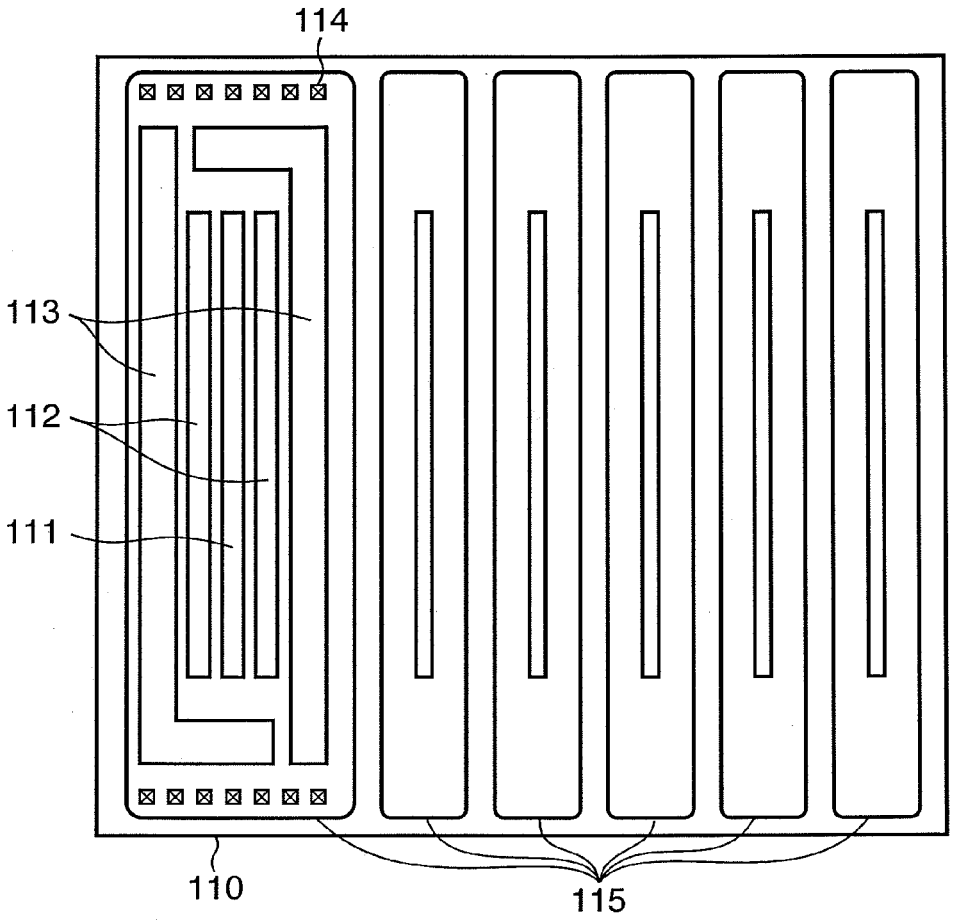
FIG. 1 PRIOR ART
FIG. 1 is a view illustrating a frame format of circuit blocks and ink supply ports of ink-jet recording head semiconductor substrate.
Figure 5:
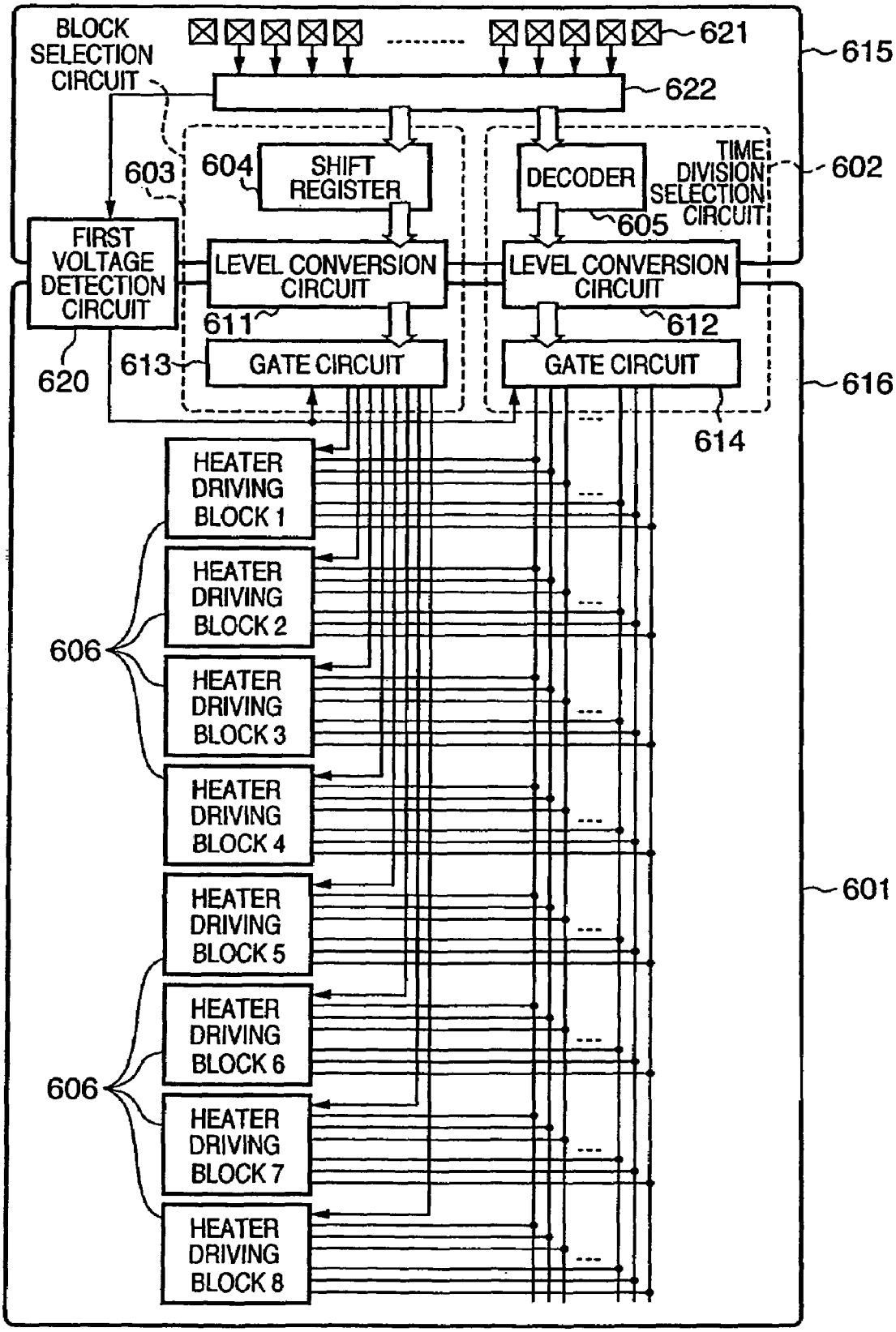
FIG. 5 is a schematic block diagram illustrating an example of a circuit configuration of an ink jet recording head substrate according to one embodiment.

FIG. 5 is a view illustrating a frame format of a circuit block diagram and flows of electric signals for describing an ink jet recording head substrate 601, hereinafter referred to as a head substrate, according to one embodiment. The ink-jet recording head substrate constitutes, for example, part of the recording heads (IJHK, IJHC) illustrated in FIG. 10. The head substrate 601 corresponds to the head substrate 51 illustrated in FIG. 11. The layout of the ink supply openings and the respective circuit blocks such as heater arrays and driving circuits is the same as in FIG. 1.

In FIG. 5, signals including image data applied to a pad 621 are inputted into a shift register 604 constituting an internal circuit through an input circuit 622, and some of output signals from the shift register 604 are further connected to a decoder 605. An output signal of the decoder 605 is supplied as a time division driving signal to each of a plurality of heater driving blocks 606 through a level conversion circuit 612 and a gate circuit 614. The decoder 605, the level conversion circuit 612 and the gate circuit 614 constitutes the time division selection circuit 602.

An image data signal synchronous with a synchronizing signal (clock) used to input an image data is inputted into the shift register 604. The shift register 604 produces a block selection signal for selecting heater driving blocks 1 to 8 based on the image data signal. A block selection signal produced by the shift register 604 is supplied to the heater driving block 606 through a level conversion circuit 611 and a gate circuit 613. The block selection signal determines effectiveness/ineffectiveness of each of the heater driving blocks 606. The heater driving block selected (made effective) by the block selection signal drives a heater in accordance with a time-division selection signal. That is, a heater driven by AND of the block selection signal and the time-division selection signal is determined. The shift register 604, the level conversion circuit 611 and the gate circuit 613 constitutes the block selection circuit 603.

As described above, in this embodiment, after a block selection signal and a time-division selection signal outputted from the shift register 604 and the decoder 605 are level-converted by the level conversion circuit 611 and 612 (after a first power voltage is converted to a second power voltage), the signal is transmitted to the heater driving block 606 through the gate circuits 613 and 614. A circuit driven a first power voltage at the same potential as an input signal amplitude is a circuit block surrounded by a rectangle 615. A circuit block driven by a second power voltage higher than a first power voltage level-converted is a circuit block surrounded by a rectangle 616. The level conversion circuits 611, 612 has a similar circuit configuration (circuit sections 304*a* and 304*b*) to the level conversion circuit illustrated in FIG. 4.

Figure 2:
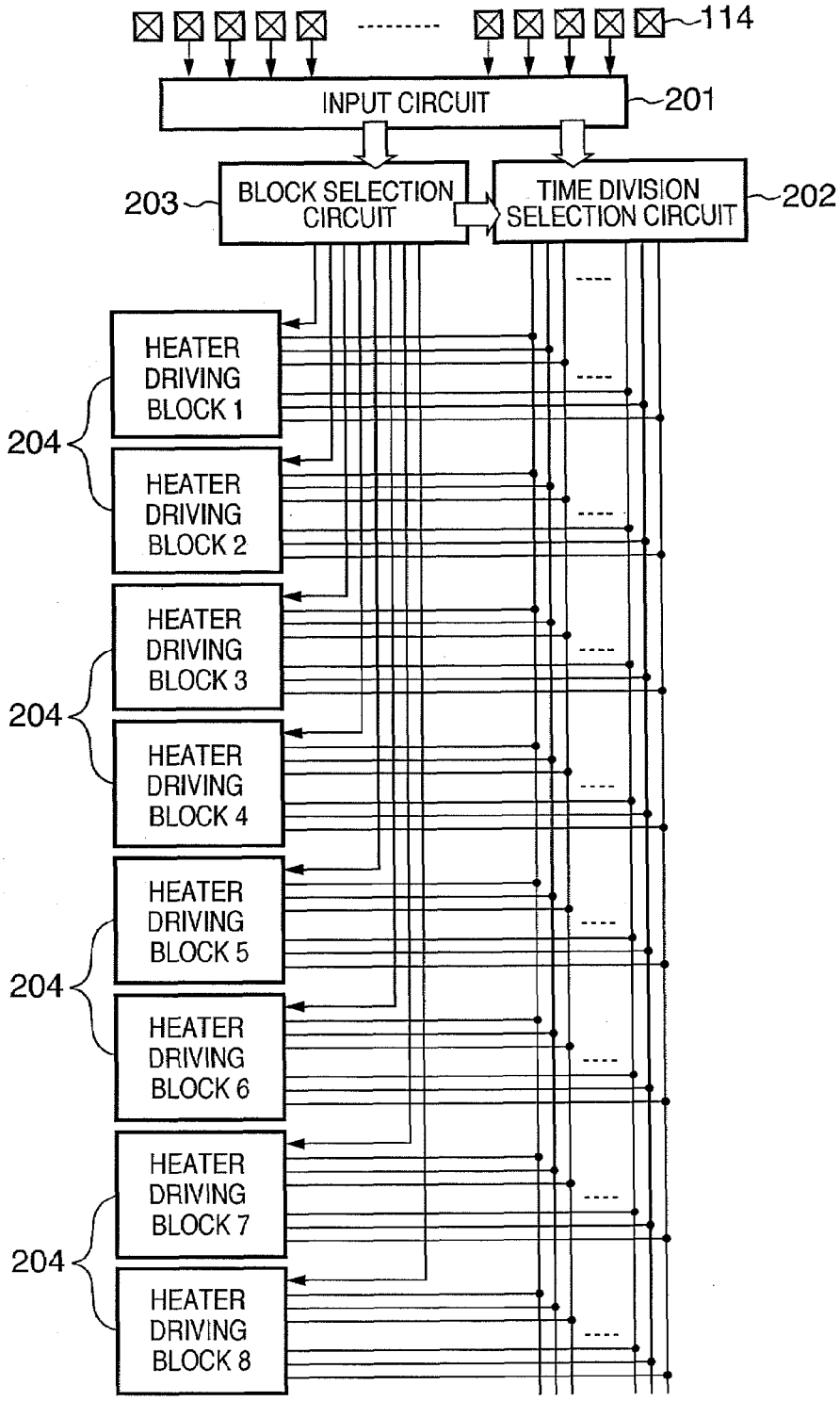
FIG. 2 PRIOR ART
FIG. 2 is a view illustrating a frame format of a circuit configuration and signal flows of a general driving circuit 113.
Figure 3:
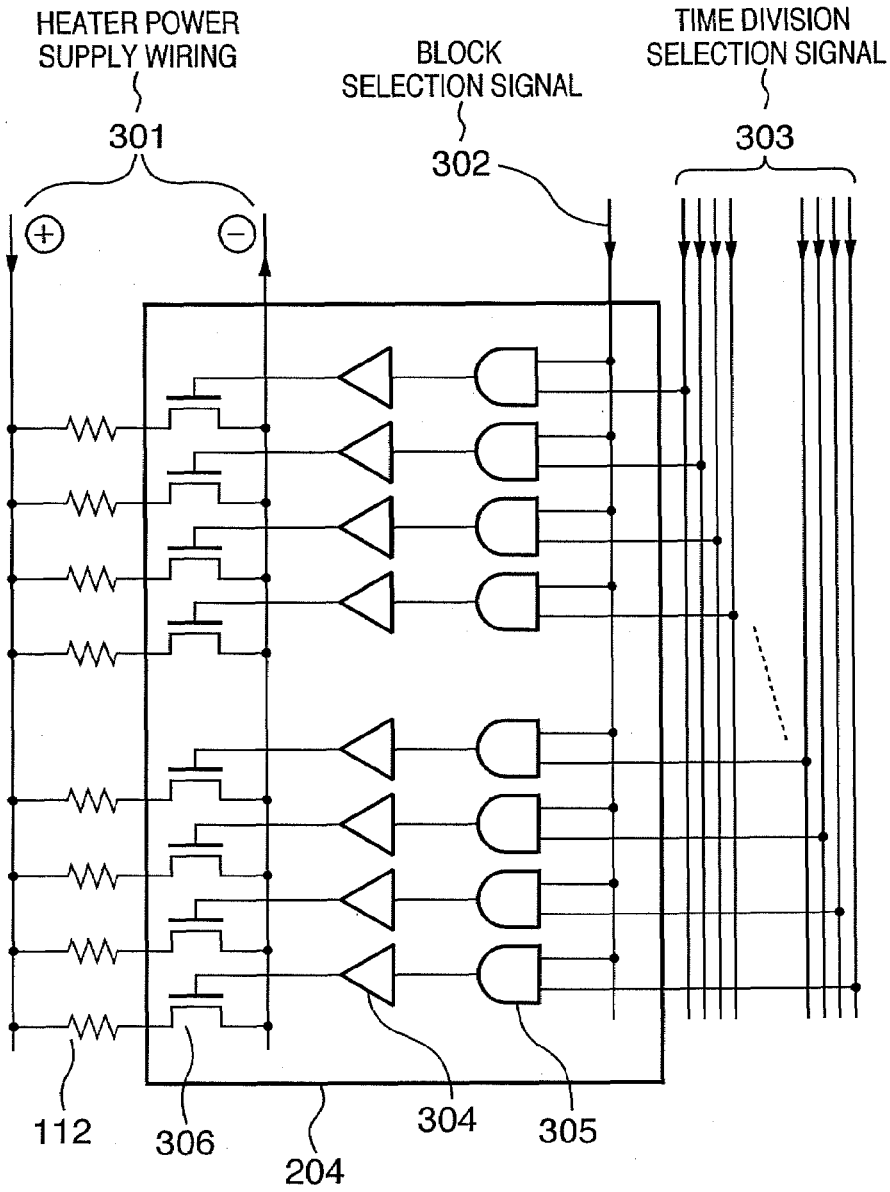
FIG. 3 PRIOR ART
FIG. 3 is a schematic block diagram illustrating an example of a circuit configuration in a general heater driving block.

In the head substrate 601 according to this embodiment, the level conversion circuits 611, 612 are provided immediately after an output of the shift register 604 or the decoder 605 for level conversion. That is, in a general circuit configuration illustrated in FIG. 2, the level conversion circuit 304 is necessary to provide for each of the heater driving blocks 204 as illustrated in FIG. 3. On the other hand, the configuration of this embodiment can eliminate need for the level conversion circuit for each heater, thus providing advantages such as high circuit density and a small layout area.

In the circuit illustrated in FIG. 5, output signals from the level conversion circuits 611, 612 are inputted into the heater driving block 606 through the gate circuits 613, 614. Signals from the shift register 604 and the decoder 605 and an output signal from a first voltage detection circuit 620 are inputted into the gate circuits 613, 614. The first voltage detection circuit 620 includes a circuit configuration illustrated later in FIG. 6 and detects whether or not a first power voltage applied to the pad 621 has reached a voltage for stably driving the level conversion circuits 611 and 612. The gate circuits 613, 614 outputs an output signal showing the logic of non-driving of the heater to the heater driving block 606 when a signal inputted from the first voltage detection circuit 620 indicates that the first power voltage is less than the voltage ensuring stable operation of the level conversion circuits 611, 612. All of I/O signals of the gate circuits 613, 614 and an output signal of the first voltage detection circuit 620 have a second power voltage amplitude.

As described above, the gate circuits 613, 614 determines effectiveness/ineffectiveness of a signal output from the time division selection circuit 602 and the block selection circuit 603 to the heater driving block 606 in accordance with an output signal of the first voltage detection circuit 620. Accordingly, if the first power voltage drops to a degree that the first power voltage cannot drive the level conversion circuits 611, 612, a signal outputted from the time division selection circuit 602 and the block selection circuit 603 is fixed at such a logical value as not to drive the heater. Because the logical value of the first voltage detection circuit 620 and the gate circuit 613, 614 is determined by a circuit operating on the second power voltage, stable operation is possible regardless of a first power voltage level.

Generally, when the first power voltage drops, the output logic of the level conversion circuits 611, 612 is unstable. Accordingly, when the outputs of the level conversion circuits 611, 612 are outputted into the heater driving blocks as they are, the unstable logic generates unexpected heater current carrying at the heater driving block 606, thus the heater may be damaged. In this embodiment, if the first power voltage drops to such a degree that the output logic of the level conversion circuits 611, 612 is unstable, the first voltage detection circuit 620 detects the state and gives it to the gate circuits 613, 614. The gate circuits 613, 614 operate on the second power voltage. When the drop in the first power voltage is given by the first voltage detection circuit 620, an output is fixed to such a logical value as to pass no heater current at the heater driving block 606 regardless of signal states of the shift register 604 and the decoder 605. This prevents the unexpected heater current carrying, thus achieving prevention of damage to the heater 112.

Figure 4:
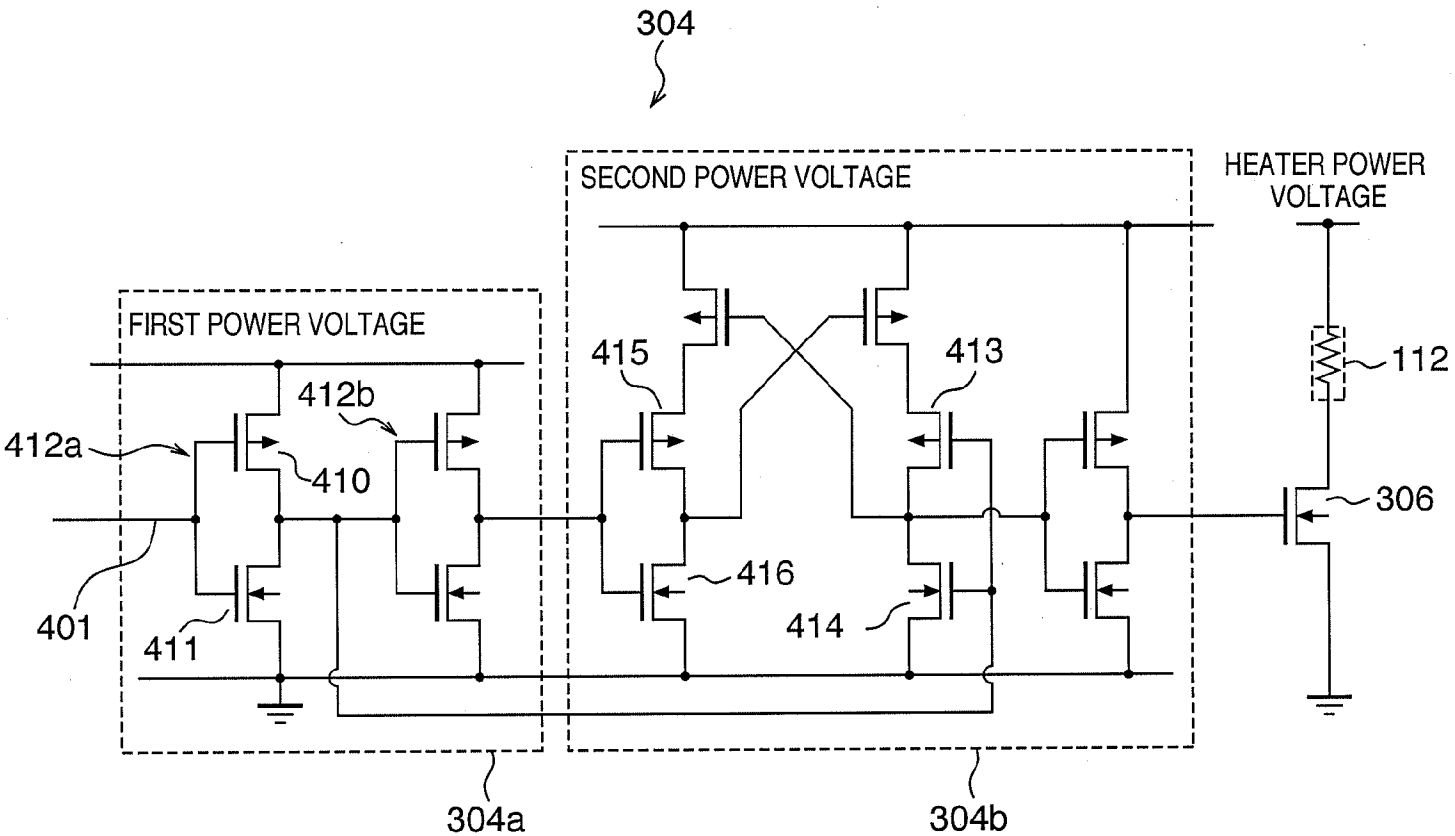
FIG. 4 PRIOR ART
FIG. 4 is a schematic block diagram illustrating an example of a circuit configuration of a level conversion circuit 304 illustrated in FIG. 3.
Figure 6:
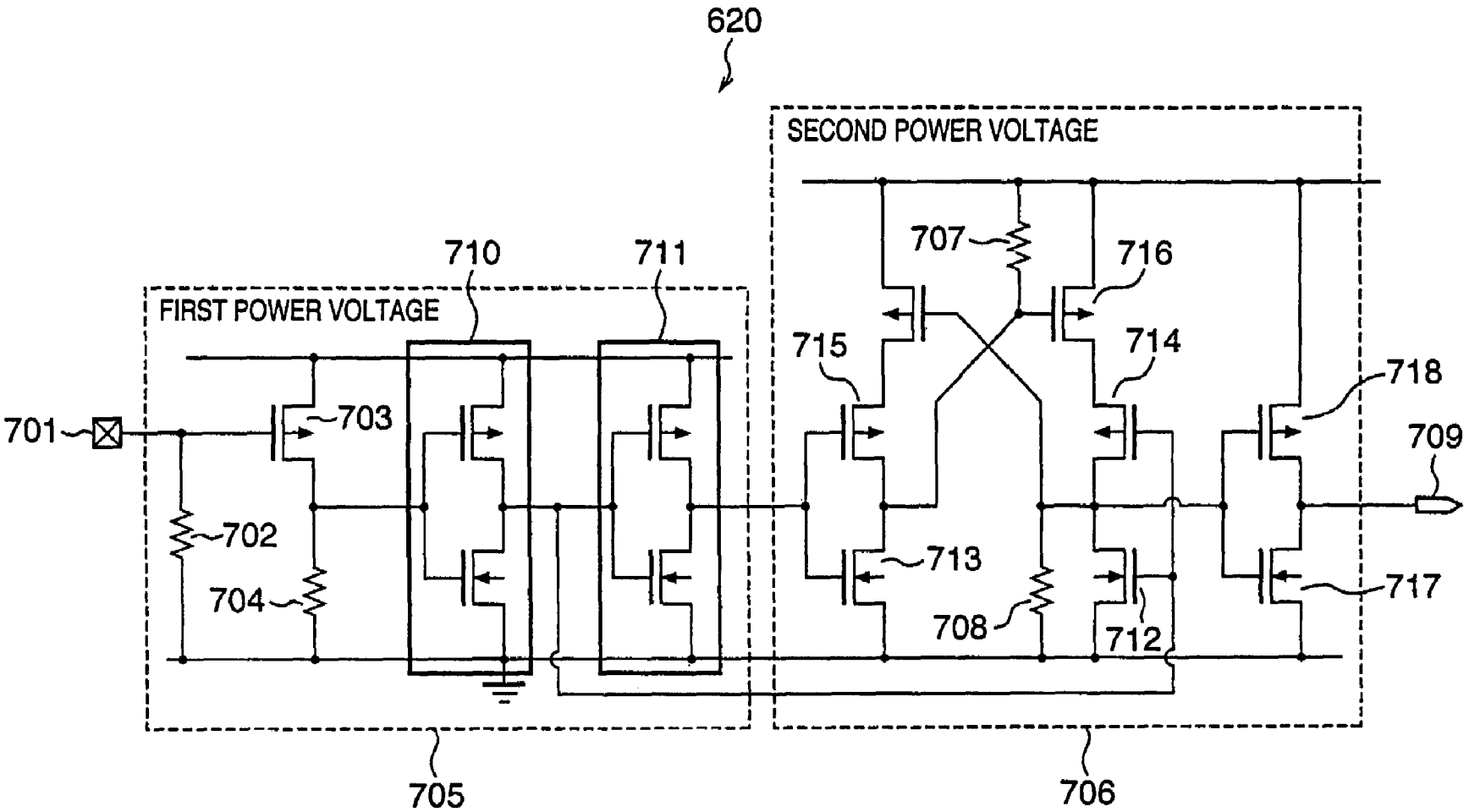
FIG. 6 is a schematic block diagram illustrating an example of a circuit configuration of a first voltage detection circuit.

FIG. 6 illustrates an example of an internal circuit of the first voltage detection circuit 620 according to this embodiment. The first voltage detection circuit 620 according to this embodiment consists of a circuit section 705 operating on a first power voltage and a circuit section 706 operating on a second power voltage. The circuit section 705 includes a test signal pad 701 connected with a pull-down resistor 702, a PMOS transistor 703 for current cut-off in which a gate is connected to the test signal pad 701 and first and second CMOS inverters 710, 711 for outputting a signal to a circuit block 706. The circuit section 706 is configurated with a pull-up resistor 707 and a pull-down resistor 708 for logic determination added to the circuit section 304*b* of the level conversion circuit illustrated by a conventional example (FIG. 4). Use of a similar circuit configuration to those of the level conversion circuits 611, 612 can exactly detect whether or not the operation of the level conversion circuits 611, 612 is unstable.

The CMOS inverters 710, 711 operating on the first power voltage connect signals inverted each other as respective output signals to two input gates of the circuit section 706. The two input gates are an input gate of the inverter consisting of MOS transistors 712, 714 and an input gate of the inverter consisting of MOS transistors 713, 715. An input gate of the first CMOS inverter 710 is connected with a potential of a connection node between the PMOS transistor 703 for current cut-off and the pull-down resistor 704. Accordingly, if a signal is not given to the test signal pad 701, a gate of the PMOS transistor 703 is fixed to a substrate potential by a pull-down resistor 702.

When the first power voltage is properly applied, the PMOS transistor 703, of which gate is fixed at a substrate potential by the pull-down resistor 702, turns on. At this time, the potential of the connection node between the PMOS transistor 703 and the pull-down resistor 704 is determined by an resistor ratio of the on-resistor of the PMOS transistor 703 and the pull-down resistor 704. The pull-down resistor 704 is set at a significantly higher value than the on-resistor of the PMOS transistor 703, so that a voltage almost equal to the first power voltage is applied to the gate of the first CMOS inverter 710.

An output signal of the first CMOS inverter 710 is connected to one side (the input gate of the inverter consisting of the MOS transistors 712, 714) of the input gate of the circuit section 706 and is inputted into the gate of the second CMOS inverter 711. A signal inverted again by the second CMOS inverter 711 is connected to the inverter consisting of the other input gates (the input gate of the inverter consisting of the MOS transistors 713, 715) of an input terminal of the circuit section 706.

The circuit section 706 (level conversion circuit) properly operates only when the first power voltage is higher than a voltage enabling normal operation of the level conversion circuit. An output of the inverter consisting of the MOS transistors 712, 714 is fixed at a high logical value, hereinafter referred to as "Hi", while an output of the inverter consisting of the MOS transistors 713, 715 is fixed at a low logical value, hereinafter referred to as "Lo". Accordingly, an input into the inverter consisting of the MOS transistors 717, 718 is Hi and, if the voltage of a first power supply is proper, Lo is outputted as a detection signal 709.

Next, let us think of a case where the level conversion circuit constituted of the circuit section 706 is difficult to operate due to a drop in the first power voltage. A state where the level conversion circuit is difficult to stably operate means that a state where turning on either of the NMOS transistors 712, 713 in the level conversion circuit is difficult to continue. The circuit section 706 operates when an output signal of either of the first and the second CMOS inverters 710, 711 of the circuit section 705 operating on the first power voltage is almost equal to the first power voltage and either of NMOS transistor 712 or 713 in the circuit section 706 is turned on in accordance with the outputted voltage. However, if the operation of the circuit section 705 becomes unstable due to a drop in the first power voltage and both of the NMOS transistors 712 and 713 turn off, the output signal becomes unstable.

On the other hand, in the circuit section 706, even if both of the NMOS transistors 712, 713 turn off, a potential of the internal node of the level conversion circuit is fixed by the pull-up resistor 707 and the pull-down resistor 708, so that the output logic does not remain unstable. Specifically, when both of the NMOS transistors 712, 713 turn off, a PMOS transistor 716 is turned off by the pull-up resistor 707 and an input into the inverter consisting of the MOS transistors 717, 718 is fixed at Lo by the pull-down resistor 708. As a result, Hi is outputted as the detection signal 709. The pull-up resistor 707 and the pull-down resistor 708 are set at a significantly higher value than the on-resistor of the MOS transistor constituting the level conversion circuit, so that the logic is determined as described above only when the first power voltage drops to such a degree as not to turn on the NMOS transistors 712, 713.

To measure current consumption of a circuit operating on the first power voltage in performing a circuit test, the PMOS transistor 703 for current cut-off is added to cut off the current running from the pull-down resistor 704. By applying a voltage having the same potential as the first power voltage to the test signal pad 701 at the time of test, the PMOS transistor 703 turn off, thus cutting off the current from the first power voltage consumed in this circuit. This respect will be further described below. The test (judgment of good/bad chip) of the general CMOS circuit demonstrates that power supply current hardly runs. This is because of one of the features of the CMOS circuit that no current runs in a static state. In the ink-jet recording head substrate as well, the test demonstrates that no current runs through VDD because a circuit is wholly constituted of CMOS. However, the first voltage detection circuit (FIG. 6) according to this embodiment uses an inverter constituted of "PMOS703+resistor 704", which consumes current because it is not of CMOS. That is, because current runs through VDD due to the inverter constituted of "PMOS+resistor", not of CMOS, it is not able to confirm whether or not current passes through any other CMOS circuit. Accordingly, a configuration which allows PMOS of the inverter by "PMOS+resistance" to be turned on and off is provided so that no current flows in this inverter. This configuration permits a test on whether current passes or not in other CMOS.

Figure 7:
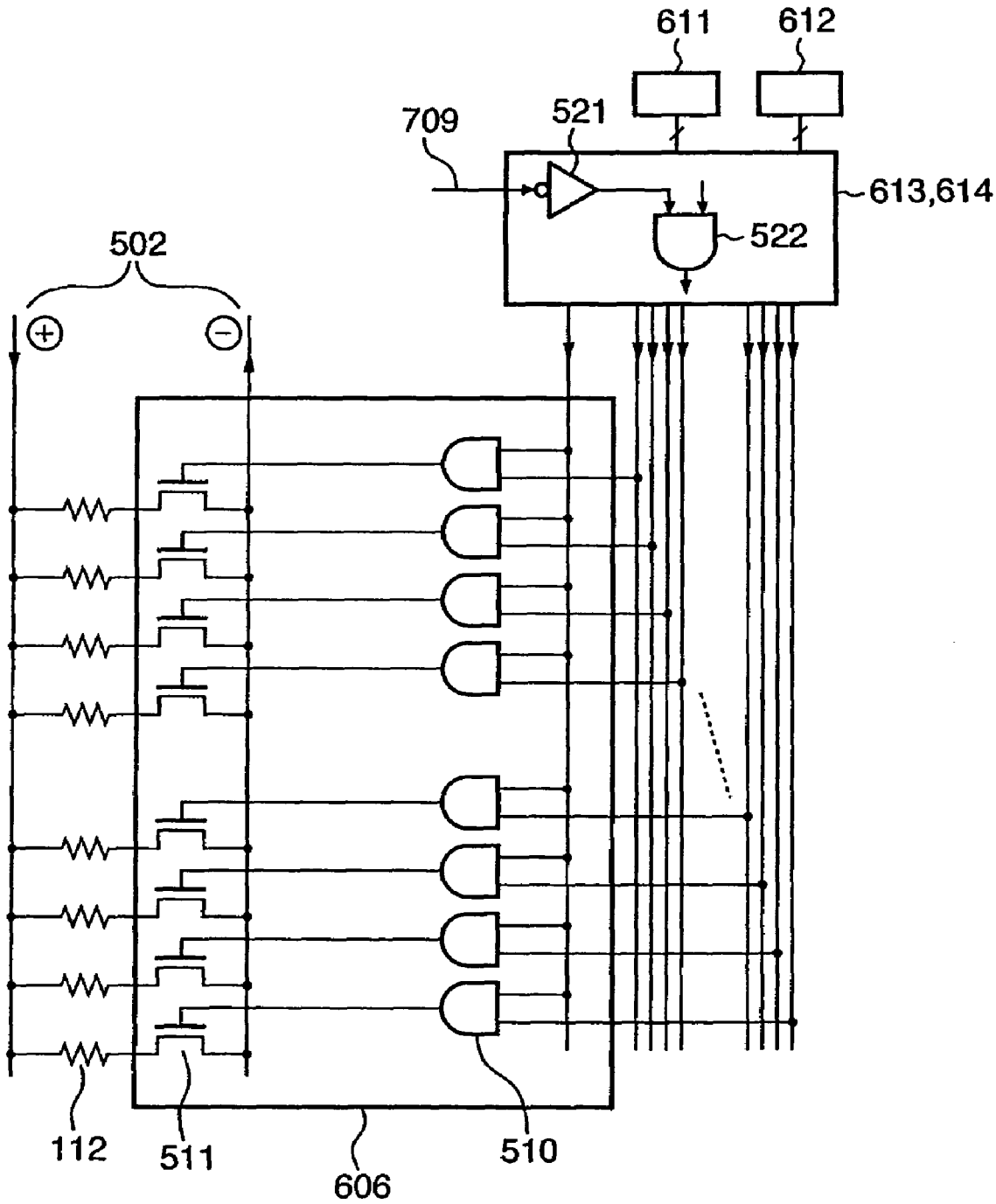
FIG. 7 is a schematic block diagram illustrating an example of a circuit configuration of gate circuits and a driving block according to the first embodiment.

FIG. 7 illustrates an example of a circuit configuration of the gate circuits 603, 604 and the heater driving block 606 according to this embodiment. To each of the gate circuits 613, 614, there are supplied a block selection signal and a time-division selection signal which are level-converted by the level conversion circuits 611, 612 and which have a second power voltage amplitude. A detection signal 709 is inputted from the first voltage detection circuit 620. By the gate circuits 613, 614, each of the block selection signal and the time-division selection signal are supplied to the heater driving block 606 through an AND gate 522. (For each signal wire, the AND gate 522 is prepared for.) A detection signal 709 of the first voltage detection circuit 620 is inputted into the other input terminals of the AND gate 522 through the inverter 521. As a result, only in the case where a detection signal 709 is Lo (the first power voltage is normal), the block selection signal and the time-division selection signal are supplied to the heater driving block 606. On the other hand, in the case where the detection signal 709 is Hi (the first power voltage is abnormal), an output of the AND gate 522 is always off, therefore the heater 501 is not driven at all.

A heater selection circuit 510, a MOS transistor 511 for heater drive and the heater 112 respectively have similar functions to the heater selection circuit 305, the heater driving MOS transistor 306 and the heater 112 illustrated in FIG. 3. However, the heater selection circuit 510 is a logic circuit for driving on the second power voltage and the level conversion circuit 304 illustrated in FIG. 3 is not present in the heater driving block.

The above-mentioned logical operations are only examples. This embodiment may be configurated so that the gate circuits 613, 614 output a logical value which allows the heater driving block 606 not to drive the heater 501 if an abnormal voltage is detected by the first voltage detection circuit 620.

As described above, the first embodiment has a configuration in which the level conversion circuit is provided at the subsequent stage of the time division selection circuit 602 and the block selection circuit 603. Accordingly, the level conversion circuit as illustrated in FIG. 4 is not required to provide for each heater, thus reducing a circuit scale. The first voltage detection circuit 620 and the gate circuits 613, 614, if the first voltage value is less than a prescribed value and the operation of the level conversion circuit is unstable, it is fixed at such a logical value as not to drive the heater at a second voltage level. If the first voltage value is less than a prescribed value, the heater will not be driven in heater driving circuit block 606. Accordingly, the heater driving block can be stably operated regardless of an input order of the first and the second power supply. Furthermore, there are no restraints on the application order of the first and the second power voltages, thus reducing the cost of a printer body.

Second Embodiment

Figure 8:
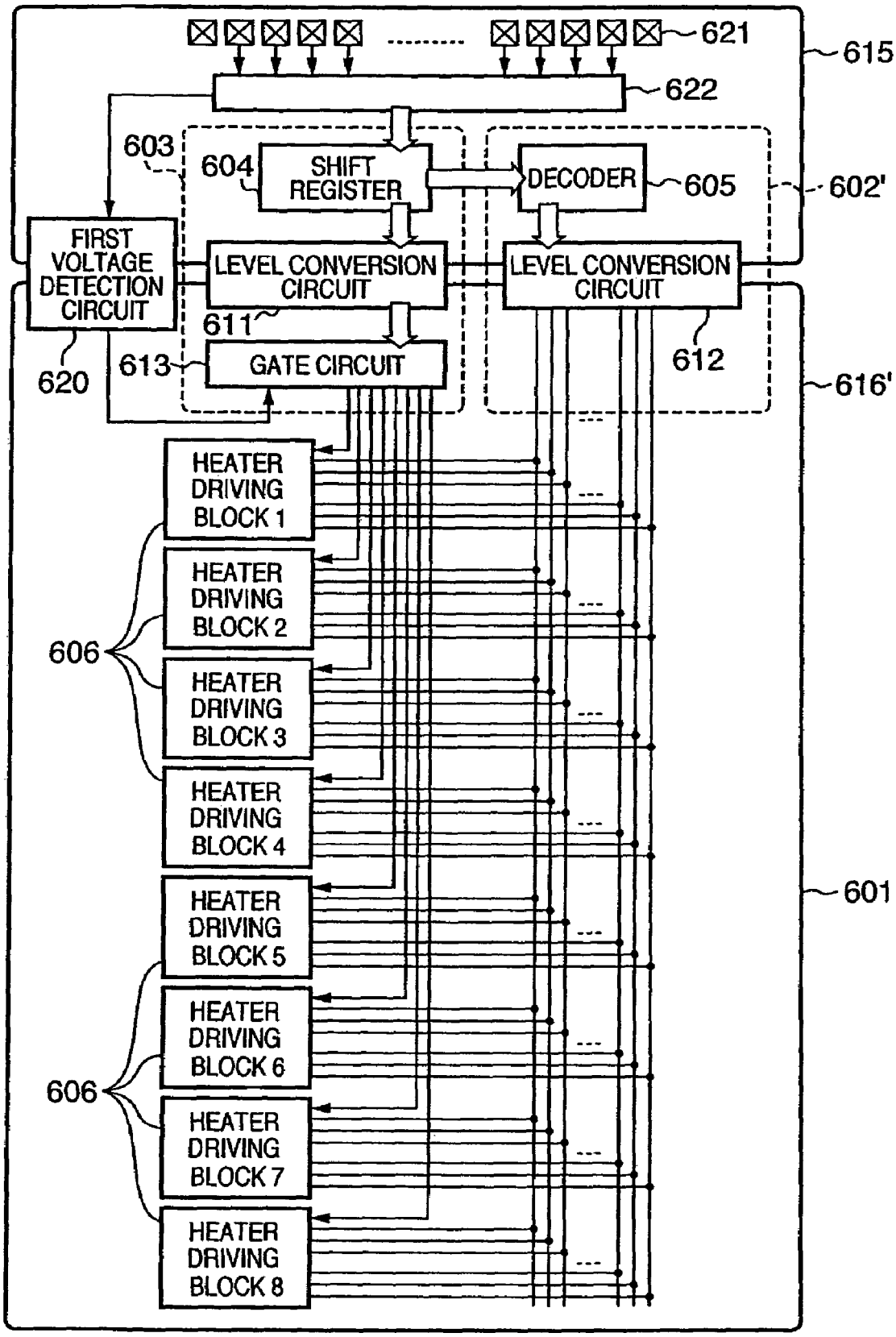
FIG. 8 is a schematic block diagram illustrating an example of a circuit configuration of an ink-jet recording head substrate according to a second embodiment.

In the first embodiment, the gate circuits 613, 614 are provided on both ends of the block selection signal and the time-division selection signal. In a second embodiment, the gate circuit 613 is provided only for the block selection signal to reduce a circuit scale. FIG. 8 is a schematic block diagram of a circuit configuration and a view showing a frame format of flows of electric signals for describing the second embodiment. In FIG. 8, parts having the same functions as those in FIG. 5 have the same reference number.

In the second embodiment, the block selection circuit 603 includes the gate circuit 613 and has the same configuration as in the first embodiment. In a time division selection circuit 602', the gate circuit is omitted. The heater selection circuit 510 (FIG. 7) corresponding to each heater becomes effective (heater driving state) only when both of a time-division selection signal from the time division selection circuit 602' and a block selection signal from the block selection circuit 603 are on. Accordingly, to prevent current from running a heater in case of an abnormal voltage, either of a time-division selection signal or a block selection signal to be inputted into an AND gate (510) may be determined as Lo. Accordingly, the gate circuit for determining effectiveness/ineffectiveness in accordance with an output state of the first voltage detection circuit may be positioned at either of the block selection circuit 603 or the time division selection circuit 602. In the second embodiment, the gate circuit 613 is provided only for the block selection circuit 603.

As described above, the second embodiment provides reduction in a layout area by reducing the number of gate circuits to be arranged, thus achieving cost reduction by chip downsizing and forming rooms for other functional circuits. In determining at which of the block selection circuit or the time division selection circuit the gate circuit should be positioned, the following step may be taken. That is, the gate circuit may be positioned at the gate selection circuit in the case of BN<HN and at the time division selection circuit in the case of BN>HN, where BN is the number of heater driving blocks in the recording head and HN is the number of heaters for each heater driving block. This is because the circuit scale of the gate circuits can be minimized. For example, in FIG. 8, when 16 heaters (nozzles) exist in each heater driving block, the scale of the gate circuits in the block selection circuit is almost a half as large as that in the time division selection circuit.

As described above, each of the embodiments prevents a heater current from running due to unstable logic, in the semiconductor substrate for the circuit of the ink-jet recording head, even if a second power voltage or a heater power voltage is applied earlier than a first power voltage. Accordingly, in a substrate for an ink-jet recording head supplied with a plurality of voltages, stable operation can be achieved even if power supply is inputted in any order, and restraints on the order of power inputs to the ink-jet recording head substrate can be eliminated. Thus, necessity of power input control by a printer body can be also eliminated for reduction in printer cost. Assembly of the first voltage detection circuit 620 and the gate circuits 613, 614 on the head substrate can be accomplished only by changing the circuit configuration of a semiconductor circuit and implementing optimum arrangement of the circuit, thus hardly causing a cost increase.

The present invention provides stable operation even if a power supply is inputted in any order and can eliminate restraints on the order of power inputs, in the ink-jet recording head substrate supplied with a plurality of voltages.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-357183 filed on Dec. 9, 2004, which is hereby incorporated by reference herein.

What is claimed is:

1. An ink-jet recording head substrate which is mounted with electrothermal transducers producing thermal energy used for discharging ink and which drives the electrothermal transducers, comprising:

an input portion to which a first voltage is input;

a production unit configured to operate on the first voltage and produce a selection signal indicating driving or non-driving of the electrothermal transducer, wherein said production unit receives signals including image data through said input portion, and produces, as the selection signal, a block selection signal and a time-division selection signal for driving the electrothermal transducers;

a conversion unit configured to convert the block selection signal and the time-division selection signal produced by the production means into the block selection signal and the time-division selection signal of a second voltage higher than the first voltage;

a driving unit having a plurality of driving elements each of which is configured to operate on the second voltage and drive the electrothermal transducer in accordance with the block selection signal and the time-division selection signal of the second voltage;

a detection unit configured to detect a voltage input from said input portion as the first voltage and output a detection signal if the first voltage is not a predetermined voltage level for driving said conversion unit; and a control unit configured to operate on the second voltage and keep the block selection signal or the time-division selection signal supplied to said driving unit under such a state as to indicate non-driving in a case where the detection signal is outputted, so that the block selection signal or the time-division selection signal output from said conversion unit is allowed to be supplied to said driving circuit only in a case where the first voltage is equal to or greater than the predetermined voltage level.

2. The substrate according to claim 1, wherein said detection unit outputs the detection signal if the first voltage reaches a level which cannot ensure normal operation of the conversion means.

3. The substrate according to claim 2, wherein said detection unit has a level conversion circuit having the same arrangements as the conversion means, takes the first voltage as an input signal of the level conversion circuit and outputs a predetermined logical value as the detection signal if the operation of the level conversion circuit is unstable due to a drop in the first voltage.

4. The substrate according to claim 3, wherein said detection unit is structured so that a NMOS transistor in the level conversion circuit may output a predetermined logical value corresponding to the detection signal in a state where the transistor cannot be turned on by the first voltage.

5. The substrate according to claim 3, wherein the input signal into said detection unit can be on-off controlled by a switch signal.

6. The substrate according to claim 5, wherein the input signal into said detection unit is pulled down by a resistor so that a substrate potential may be inputted if the first power voltage is not applied.

7. The substrate according to claim 1, wherein said control unit includes a logical gate taking a detection signal from said detection unit and a selection signal from said conversion unit as inputs and outputting the selection signal as a state indicating non-driving if the detection signal is inputted.

8. The substrate according to claim 1, wherein a plurality of electrothermal transducers are divided into a plurality of blocks and said driving unit drives the plurality of electrothermal transducers in units of blocks;

the selection signal includes a block selection signal for selecting one of the plurality of blocks and a time-division selection signal indicating driving or non-driving of respective electrothermal transducers belonging to the selected block; and said control unit sets at least either of the block selection signal or the time-division selection signal in a state indicating non-driving if the detection signal is outputted.

9. An ink-jet recording head comprising an ink-jet recording head substrate according to claim 1.

10. The ink-jet recording head according to claim 9, wherein recording is performed by discharging ink.

11. A head cartridge comprising:

an ink-jet recording head according to claim 10; and an ink tank storing ink for supplying ink to the ink-jet recording head.

12. A recording device comprising the head cartridge according to claim 11, and wherein said device performs recording using the head cartridge.

13. A recording device comprising a recording head according to claim 9, and wherein said device performs recording using said recording head.

* * * * *